US005540327A

United States Patent [19]

Creeron

[11] Patent Number: 5,540,327

[45] Date of Patent: Jul. 30, 1996

[54] ANTIFREEZE/COOLANT REPLACEMENT KIT

[75] Inventor: Richard F. Creeron, Valley Stream, N.Y.

[73] Assignee: Prestone Products Corporation, Danbury, Conn.

[21] Appl. No.: 67,271

[22] Filed: May 24, 1993

Related U.S. Application Data

[63] Continuation-in-part of Ser. No. 751,411, Aug. 28, 1991.

[51] Int. Cl.[6] ..... B65B 39/00

[52] U.S. Cl. ..... 206/223; 141/98; 141/334

[58] Field of Search ..... 141/98, 331, 337, 141/339, 333, 334; 220/573; 206/223

[56] References Cited

U.S. PATENT DOCUMENTS

| | | | |
|---|---|---|---|
| 481,872 | 8/1892 | Roos | 141/334 |
| 2,029,232 | 1/1936 | Green . | |
| 4,276,914 | 7/1981 | Albertson | 141/92 |
| 5,020,577 | 6/1991 | McMillan | 141/92 |
| 5,092,457 | 3/1992 | Islava et al. | 206/223 |

*Primary Examiner*—Neil McCarthy
*Attorney, Agent, or Firm*—Cummings & Lockwood

[57] ABSTRACT

The present invention features a kit and method for replacing used antifreeze/coolant in the cooling system of an automobile. The kit is composed of inexpensive parts, consisting of: (1) a plastic, flexible capture tank; (2) a flexible plastic drain sleeve for directing fluid from a cooling system hose to the capture tank; (3) a funnel for introducing fluids into the cooling system via said radiator; (4) a hose adaptor for placement of a funnel into the hose line; (5) differently-sized hose menders for re-establishing a severed radiator hose line; and (6) metal clamps for tightening the severed hose portions about one of the appropriately sized hose menders.

2 Claims, 3 Drawing Sheets

FIG. 1A
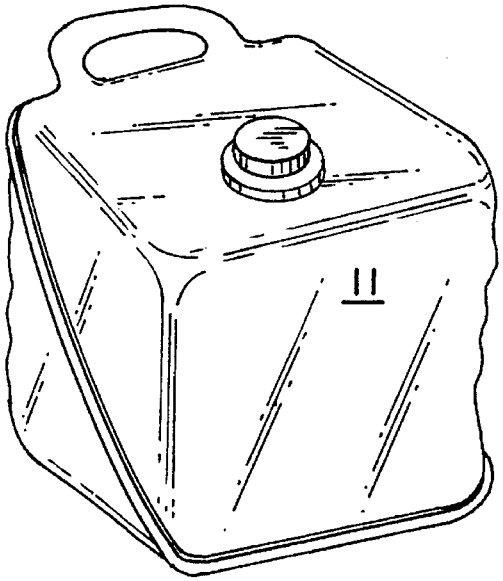
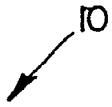
FIG. 1C
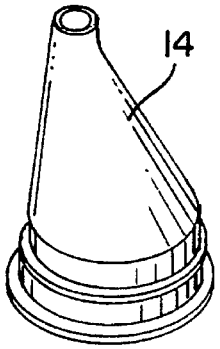
FIG. 1D
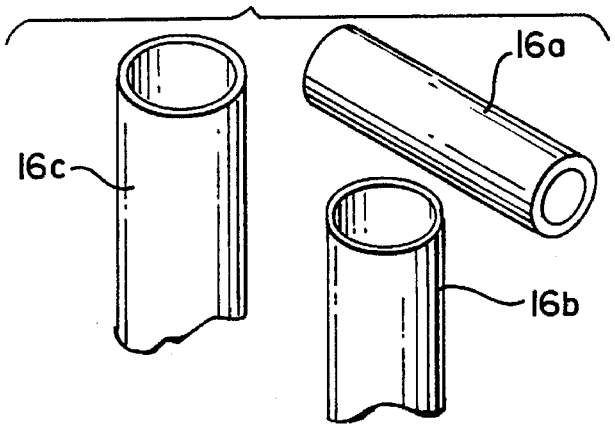
FIG. 1B
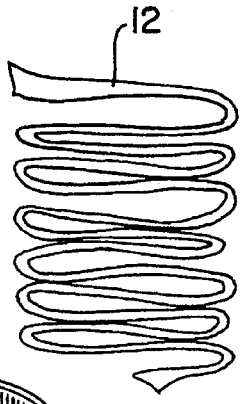
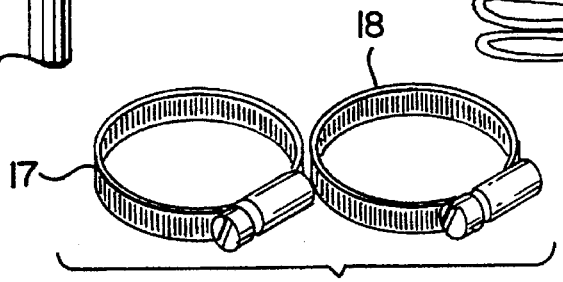
FIG. 1E FIG. 2
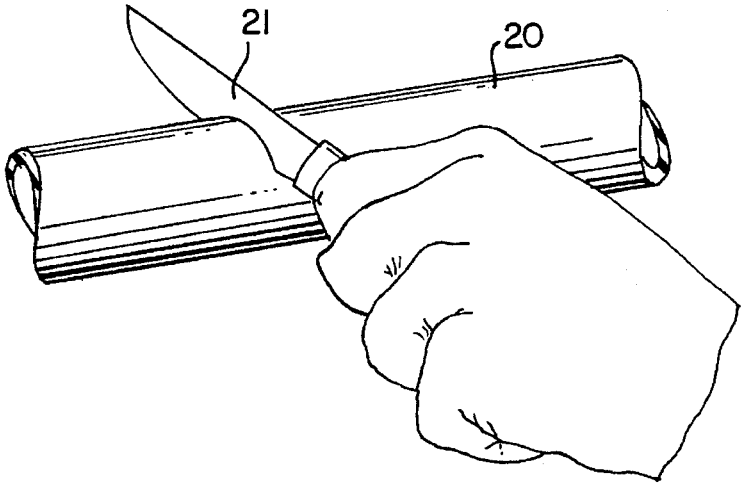
FIG. 3
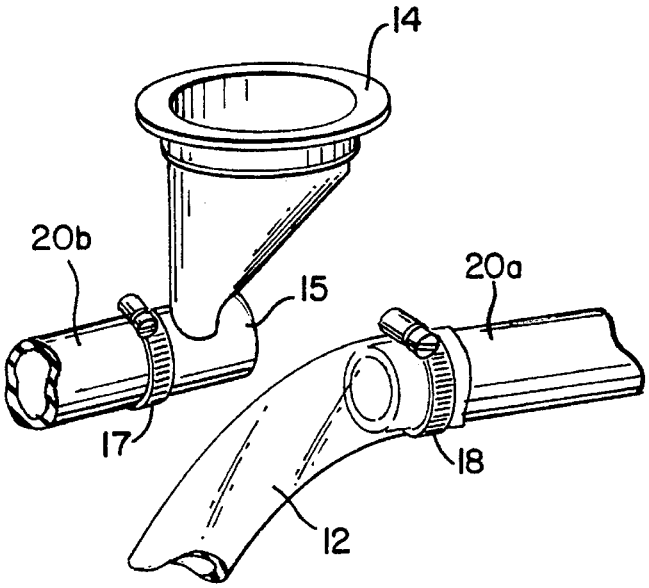
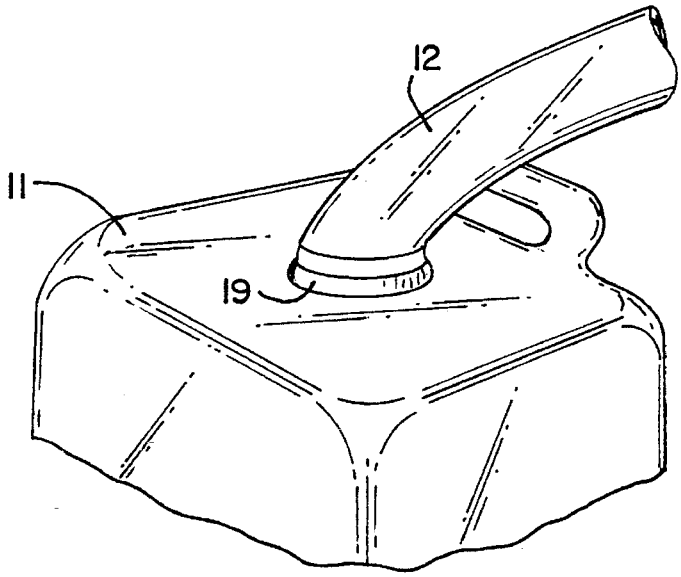
FIG. 4

ANTIFREEZE/COOLANT REPLACEMENT KIT

CROSS REFERENCE TO RELATED APPLICATION

This application is a continuation-in-part of U.S. Ser. No. 07/751,411, filed Aug. 28, 1991.

FIELD OF THE INVENTION

The present invention pertains to a kit for flushing the engine and radiator of used antifreeze/coolant and replacing it with fresh antifreeze/coolant, and, more particularly, to an antifreeze/coolant replacement kit that is designed for the "do-it-yourself" automobile owner.

BACKGROUND OF THE INVENTION

A large number of on-the-road vehicle breakdowns are due to the lack of proper antifreeze/coolant maintenance. Car manufacturers and maintenance personnel recommend periodic or annual flushing and replacement of the antifreeze/coolant in the cooling system of an automobile. Despite this known fact, many individual car owners pay little attention to the heating and cooling systems of their vehicles, often neglecting maintenance until trouble develops.

It is a common misconception that antifreeze/coolant does not deteriorate and, therefore, will not need replacement. This erroneous belief overlooks the fact that, over time, most antifreeze/coolants lose their anti-corrosive properties. Thus, a cooling system requires periodic flushing to remove rust and to prevent the build-up of corrosion in the cooling system and engine.

One reason for lax attention to this maintenance is due to the high cost of adding antifreeze coolant at a garage or automotive repair or maintenance facility; due to a high retail mark-up, the charge for replacement is often expensive.

Another problem associated with antifreeze/coolant replacement has been spawned by recent federal Environmental Protection Agency (EPA) requirements prohibiting the careless disposal of used automotive fluids. There has been a long-felt need for a simple, inexpensive kit that could be used by the average car owner for the replacement of antifreeze/coolant in the cooling system of an automobile. In addition, such a kit would need to have some kind of container for capturing the used fluid that is drained from the cooling system. The present invention provides such a simple, inexpensive antifreeze/coolant replacement kit for the "do-it-yourself" car owner.

The kit of this invention provides inexpensive components in kit form, such as plastic couplings, funnels and capture tanks. The kit is easy to use and, therefore, takes much of the effort out of the replacement chore. Another advantage of this kit is that it allows car owners to easily perform at home the recommended periodic maintenance of an automotive cooling system.

The kit also provides a means for capturing the used fluid to ease in disposal at officially designated waste disposal facilities.

Lastly, the kit of this invention can be used with almost any water-cooled engine, requiring no modification of the automobile cooling system or radiator.

DISCUSSION OF RELATED ART

In U.S. Pat. No. 5,097,894, issued to Cassia on Mar. 24, 1992, and entitled "Vehicular Flushing and Draining Apparatus and Method", a system is illustrated for the replacement of used antifreeze/coolant. The system is not universally applicable; it requires different embodiments and modifications in order that it be operable with various types of cooling systems. In addition, the invention requires that the radiator be modified in order to be adaptive to the flushing apparatus.

In contrast, the present invention is adaptable to almost all automobile cooling systems and it features only one embodiment. Furthermore, the current invention requires no modification of the radiator or any other parts of the cooling system.

In U.S. Pat. No. 2,029,232, issued to Green on Jan. 28, 1936, and entitled "Reversible Flusher for Cleaning Automobile Water Cooling Systems", a valving apparatus for reversing the flow through a cooling system is shown. Illustrated is a two-way valve hook-up for the removal of old fluid and the introduction of new fluid into a cooling system. Such a system requires elaborate extraneous hosing and, unfortunately, cannot be considered a low-cost flushing and replacement method.

Over fifty years have passed since the aforementioned patents, and the problem of providing a simple, inexpensive method of periodic antifreeze/coolant flushing and replacement still exists.

SUMMARY OF THE INVENTION

In accordance with the present invention, there are provided a kit and method for replacing used antifreeze/coolant in the cooling system of an automobile. The kit is composed of nine inexpensive parts, comprising:

a) a plastic, flexible capture tank;

b) a flexible plastic drain sleeve for directing fluid from a cooling system hose to the capture tank;

c) a funnel for introducing fluids into the cooling system via said radiator;

d) a hose adaptor for placement of a funnel into the hose line;

e) optionally a hose connector, preferably three differently-sized hose menders for re-establishing a severed radiator hose line; and f) two metal clamps for tightening the severed hose portions about one of the appropriately sized hose menders.

The method of the invention is simple, easy to accomplish and comprises the following steps:

a) making a cut in an upper radiator hose disposed between the engine and the radiator;

b) attaching the hose adaptor into one end of the severed radiator hose and, thereafter, inserting thereinto the funnel;

c) attaching a drain sleeve to the other end of the cut radiator hose and then placing the sleeve into the capture tank;

d) adding flushing water to the funnel, so that water is introduced into the radiator during the flushing procedure;

e) thereafter, adding fresh antifreeze/coolant to the radiator via said funnel;

f) mending the severed radiator hose by inserting the appropriately sized mending sleeve into both ends of the cut hose; and g) then attaching both severed ends by clamping the severed ends of the hose about the mending sleeve with the two metal clamps.

It is an object of the present invention to provide a low-cost kit for the flushing and replacement of used antifreeze/coolant for an automobile cooling system.

It is a further object of this invention to provide the individual car owner with an apparatus and method for easily replacing the antifreeze/coolant of an automobile cooling system.

It is another object of the current invention to provide a minimal number of low-cost parts for a kit system for replacing the used antifreeze/coolant in a cooling system of an automobile.

BRIEF DESCRIPTION OF THE DRAWING

A complete understanding of the present invention may be obtained by reference to the accompanying drawings, when considered in conjunction with the subsequent detailed description, in which:

FIG. 1 is a perspective view of the parts of the kit of this invention, as disposed upon a table prior to exercising the inventive method of replacing the antifreeze/coolant in the cooling system of an automobile;

FIGS. 2 through 7, described in greater detail hereinbelow, depict various sequential method steps in the performance of the method of the invention, in accordance with the kit illustrated in FIG. 1:

FIG. 2 depicts a schematic view of the step of severing the upper hose of an automobile radiator;

FIG. 3 shows a schematic view of the attachment of the draining sleeve and funnel to the respective severed ends of the radiator hose, as illustrated in FIG. 2;

FIG. 4 depicts a schematic view of the insertion of the drainage sleeve into the capture tank, as illustrated in FIG. 1;

FIG. 5 is an in situ view of the funnel and the drainage sleeve attached to opposite ends of a severed radiator hose, and the addition of water into the attached funnel as the used antifreeze/coolant is drained from the cooling system of the automobile;

FIG. 6 is a schematic view of the subsequent step of adding fresh antifreeze/coolant to the cooling system of the automobile; and FIG. 7 is a schematic view depicting the reattachment of the severed ends of the radiator hose depicted in FIG. 2.

Figure 7:
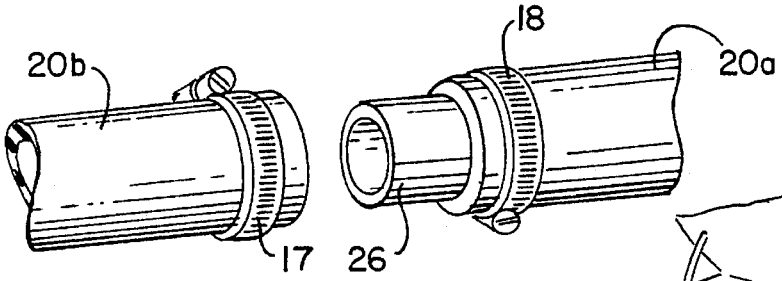

For purposes of clarity and brevity, like components will bear the same designation throughout the FIGURES.

DESCRIPTION OF THE PREFERRED EMBODIMENT

Generally speaking, the invention is for a kit and method of flushing and replacing antifreeze/coolant in the cooling system of an automobile. The kit and inventive method are designed to be extremely inexpensive and simple, so that the average automobile owner (and "do-it-yourselfer") can utilize and benefit from this invention.

Now referring to FIG. 1, the various parts of the kit of this invention (as shown by arrow 10) are displayed as they would likely be disposed or laid out upon a worktable prior to being used. The parts 10 of the kit are packaged in a box with appropriate labelling and instructions. The parts 10 consist of: (1) a plastic, flexible capture tank 11 for containing the used antifreeze/coolant; (2) a flexible plastic drain sleeve 12 (illustrated in its rolled-up form, as packaged) for directing fluid to the capture tank 11 from one end of a radiator hose that has been severed; (3) a funnel 14 for introducing fluids into the cooling system after its attachment to the other end of the severed radiator hose; (4) a hose adaptor 15 for placement of the funnel 14 into one end of the severed hose line; (5) three differently-sized hose menders **16*a*, 16*b* and 16*c*, respectively, for re-establishing the opened hose line; and (6) two metal clamps 17 and 18, respectively, for tightening both ends of the opened hose about a hose mender 16*a*, 16*b* or 16*c***, respectively, as befits the proper size of the severed radiator hose.

Now referring to FIG. 2, a schematic view of the first step of utilizing the invention is shown, in accordance with the components illustrated in FIG. 1. The person performing this maintenance is instructed to determine the automobile's cooling system capacity and to obtain thereby the necessary quantity of replacement antifreeze/coolant. After loosening and retightening the radiator cap of a cool engine to relieve any built-up pressure, the upper radiator hose 20 is severed by a sharp knife 21 or other cutting instrument.

Referring to FIG. 3, the two respective halves **20*a* and 20*b* of the severed radiator hose are shown. Hose end 20*b* leads to the radiator (not shown), and hose end 20*a* leads from the engine. Respective metal clamps 17 and 18 are loosely fitted about hose halves 20*a* and 20*b*, as illustrated. The hose adaptor 15 is inserted into the hose end 20*b* and secured by the metal clamp 17. The hose adaptor has an aperture (not shown) for the insertion of the funnel 14. The adaptor 15 is inserted into the hose end 20*b* with the aperture facing upwardly, so that the funnel 14** can be inserted into the aperture in an upright position for receiving liquids.

Figure 5:
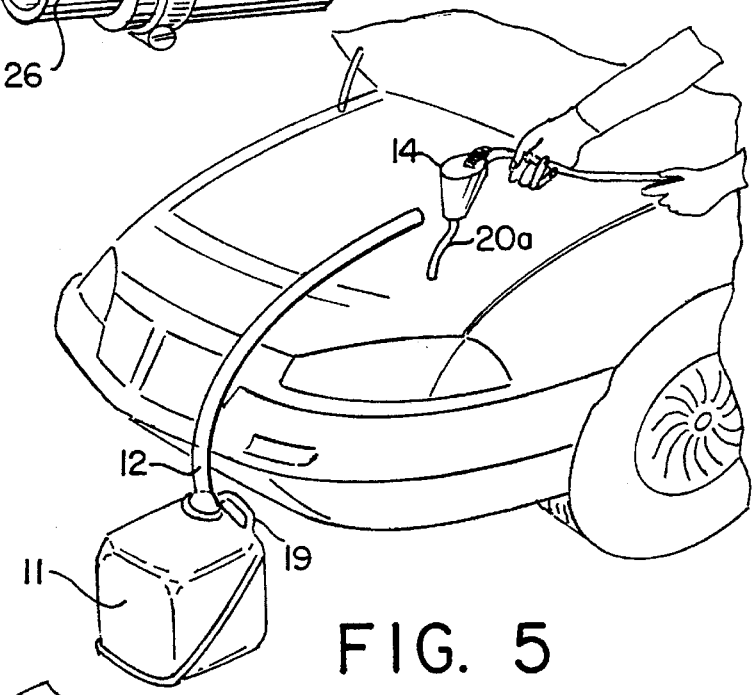

The drain sleeve 12 is secured to hose end **20*a* by means of clamp 18. The plastic, capture tank 11 (FIG. 4) is placed on the ground in front of the automobile, as illustrated in FIG. 5, and the drain sleeve 12 is inserted into the opening 19 (FIG. 4**).

The automobile cooling system can now be flushed. As is shown in FIG. 5, a common garden hose 24 is positioned above the funnel 14, which is thereby filled with water.

The heater and the engine of the automobile are turned on, and the antifreeze/coolant is allowed to flow out of hose end **20*a* into the capture tank 11. The funnel 14** is kept filled with water until the correct amount of used antifreeze/coolant is drained from the engine.

Figure 6:
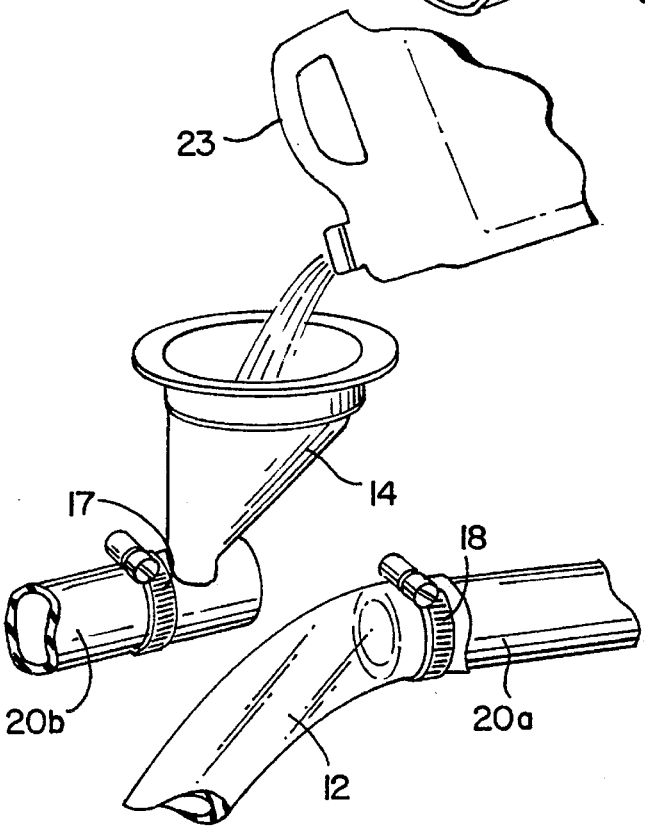

Referring to FIG. 6, a container 23 of antifreeze/coolant is next positioned over the funnel 14 and its contents poured into the radiator through hose **20*b*. When the correct amount of antifreeze/coolant is introduced, the engine is turned off. The flow through the drain sleeve 12** will automatically terminate at this point.

The funnel 14 and funnel adaptor 15 are then removed from hose **20*b* by loosening metal clamp 17. Likewise, the drain sleeve 12 is removed from hose 20*a* by loosening metal clamp 18**.

Now referring to FIG. 7, the severed, upper radiator hose 20 (now represented by halves **20*a* and 20*b*) is now ready to be mended, i.e., halves 20*a* and 20*b* shall be joined. An appropriately sized hose mender 16*a*, 16*b* or 16*c*, is respectively inserted halfway into hose end 20*a*, and clamp 18 is tightened. Next, the extending half 26 of the hose mender is inserted into hose end 20*b*, and clamp 17** is tightened to form a complete liquid seal. Additional water may now be added to the radiator through the radiator cap, if necessary.

All of the components 10 of the invention are made of low-cost plastic, such as polyethylene or polypropylene, with the exception of the metal clamps 17 and 18. As such, the kit is quite inexpensive to produce and sell.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed:

1. A kit for replacing used antifreeze/coolant in a cooling system of a motor vehicle having a first cooling system hose and a second cooling system hose, said first and second hoses formed from severing an upper radiator hose, comprising:

a) a plastic, flexible capture tank for containing the used antifreeze/coolant;

b) a flexible plastic drain for directing fluid from said first cooling system hose to said capture tank;

c) a funnel for introducing fluids into the cooling system of said motor vehicle via an adaptor for placement into said second cooling system hose, said adaptor having means defining an aperture for placement of the funnel into the adaptor for fluid communication with said second cooling system hose;

d) differently-sized hose menders for re-establishing said severed upper radiator hose line; and e) clamps for tightening opposite ends of said severed hose line about one of the appropriately-sized hose menders.

2. The kit for replacing used antifreeze/coolant in accordance with claim 1, wherein components (a) through (d) consist of plastic.

* * * * *